US012722250B2

(12) United States Patent
Kwon et al.

(10) Patent No.: US 12,722,250 B2
(45) Date of Patent: Sep. 1, 2026

(54) POLISHING APPARATUS FOR SUBSTRATE AND POLISHING METHOD FOR SUBSTRATE USING THE SAME

(71) Applicant: Samsung Electronics Co., Ltd., Suwon-si (KR)

(72) Inventors: Donghoon Kwon, Hwaseong-si (KR); Hyojung Kim, Hwaseong-si (KR); Chungki Min, Hwaseong-si (KR); Kihoon Jang, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 723 days.

(21) Appl. No.: 17/931,948

(22) Filed: Sep. 14, 2022

(65) Prior Publication Data

US 2023/0286108 A1 Sep. 14, 2023

(30) Foreign Application Priority Data

Mar. 10, 2022 (KR) ..... 10-2022-0030060

(51) Int. Cl.

| | |
|---|---|
| ***B24B 55/02*** | (2006.01) |
| ***B24B 37/10*** | (2012.01) |
| ***B24B 37/34*** | (2012.01) |
| ***B24B 53/017*** | (2012.01) |
| ***B24B 57/02*** | (2006.01) |

(52) U.S. Cl.

CPC ..... *B24B 55/02* (2013.01); *B24B 37/107* (2013.01); *B24B 37/34* (2013.01); *B24B 53/017* (2013.01); *B24B 57/02* (2013.01)

(58) Field of Classification Search

CPC ... B24B 37/005; B24B 37/015; B24B 37/013; B24B 37/042; B24B 37/044; B24B 41/007; B24B 49/14; B24B 49/08; B24B 53/095; B24B 57/02; B24B 53/017

USPC ..... 451/7, 53, 36, 41

See application file for complete search history.

(56) References Cited

U.S. PATENT DOCUMENTS

| | | | | |
|---|---|---|---|---|
| 5,651,725 | A | 7/1997 | Kikuta et al. | |
| 6,530,827 | B2 * | 3/2003 | Mitsuhashi | B24B 57/02 451/72 |
| 6,561,878 | B2 * | 5/2003 | Chopra | B24B 37/04 451/288 |

(Continued)

FOREIGN PATENT DOCUMENTS

| | | | |
|---|---|---|---|
| JP | 2003-324085 | A | 11/2003 |
| JP | 5722619 | B2 | 4/2015 |

*Primary Examiner* — Makena S Markman

(74) *Attorney, Agent, or Firm* — Wolf, Greenfield & Sacks, P.C.

(57) ABSTRACT

A polishing apparatus for a substrate, includes: a platen having a polishing pad attached to an upper surface thereof, and configured to rotate in a rotational direction, a temperature control unit configured to spray a temperature control fluid onto the polishing pad, a slurry supply unit configured to supply a slurry to the polishing pad, a polishing head on the polishing pad, and configured to rotate a semiconductor substrate in contact with the polishing pad, and a first fence between the temperature control unit and the slurry supply unit extending from a center outwardly, along the rotational direction, to control a flow of the temperature control fluid, wherein the temperature control unit, the slurry supply unit, and the polishing head are sequentially positioned along the rotational direction.

19 Claims, 6 Drawing Sheets

(56) References Cited

U.S. PATENT DOCUMENTS

| | | | | |
|---|---|---|---|---|
| 6,887,132 | B2 * | 5/2005 | Kajiwara | B24B 37/04 451/60 |
| 2003/0207654 | A1 * | 11/2003 | Hamayasu | B24B 37/04 451/36 |
| 2011/0081832 | A1 * | 4/2011 | Nakamura | B24B 57/02 451/28 |
| 2016/0016283 | A1 * | 1/2016 | Butterfield | B24B 53/017 156/345.12 |
| 2019/0039203 | A1 * | 2/2019 | Toriyabe | B24B 53/017 |
| 2021/0229240 | A1 | 7/2021 | Sotozaki et al. | |
| 2021/0331288 | A1 | 10/2021 | Yang et al. | |
| 2021/0370462 | A1 | 12/2021 | Huang et al. | |

* cited by examiner

POLISHING APPARATUS FOR SUBSTRATE AND POLISHING METHOD FOR SUBSTRATE USING THE SAME

CROSS-REFERENCE TO RELATED APPLICATION

This application claims the priority and benefit of Korean Patent Application No. 10-2022-0030060, filed on Mar. 10, 2022, with the Korean Intellectual Property Office, the disclosure of which is incorporated herein by reference.

BACKGROUND

1. Field

The present inventive concept relates to a polishing apparatus for a substrate and a polishing method for a substrate using the same.

2. Description of Related Art

A semiconductor device may be manufactured through various processes. For example, the semiconductor device may be manufactured through a photoetching process, an etching process, a deposition process, and the like on a wafer. Prior to each process, it may be necessary to planarize a surface of the wafer. To this end, a polishing process may be performed on the wafer. The polishing process may be performed using various methods. For example, a chemical mechanical polishing (CMP) process may be used to planarize the wafer.

Recently, a temperature control fluid has been sprayed during the CMP process to control a temperature at which the CMP process is performed.

SUMMARY

An aspect of the present inventive concept is to provide a polishing apparatus for a substrate and a polishing method for a substrate, capable of optimizing a surface temperature of a polishing pad in a CMP process and reducing or preventing mixing of a temperature control fluid and a slurry.

According to an aspect of the present inventive concept, a polishing apparatus for a substrate is provided, the polishing apparatus for a substrate including: a platen having a polishing pad attached to an upper surface thereof, and configured to rotate in a rotational direction, a temperature control unit configured to spray a temperature control fluid to control a temperature of the polishing pad onto the polishing pad, a slurry supply unit on the polishing pad spaced apart from the temperature control unit along the rotational direction, and configured to supply a slurry to the polishing pad, a polishing head on the polishing pad to be spaced apart from the slurry supply unit along the rotational direction, and configured to rotate a semiconductor substrate in contact with the polishing pad, a first fence between the temperature control unit and the slurry supply unit along the rotational direction, and extending from a center of the polishing pad outwardly to control a flow of the temperature control fluid, and a second fence between the polishing head and the temperature control unit along the rotational direction, and extending from the center of the polishing pad outwardly to control a flow of a slurry and polishing by-products remaining in the polishing pad.

According to an aspect of the present inventive concept, a polishing apparatus for a substrate is provided, the polishing apparatus for a substrate, including: a platen having a polishing pad attached to an upper surface thereof, and configured to rotate in a rotational direction, a temperature control unit configured to spray a temperature control fluid onto the polishing pad, a slurry supply unit configured to supply a slurry to the polishing pad, a polishing head on the polishing pad, and configured to rotate a semiconductor substrate in contact with the polishing pad, and a first fence between the temperature control unit and the slurry supply unit along the rotational direction extending from a center of the polishing pad outwardly, to control a flow of the temperature control fluid, wherein the temperature control unit, the slurry supply unit, and the polishing head are sequentially positioned along the rotational direction.

According to an aspect of the present inventive concept, a polishing apparatus for a substrate is provided, the polishing apparatus for a substrate including: a platen supporting a polishing pad and configured to rotate in a rotational direction, a temperature control unit configured to spray a temperature control fluid onto the polishing pad, a first fence at a rear end of the temperature control unit along the rotational direction, and extending from a center of the polishing pad outwardly and configured to control a flow of the temperature control fluid, a slurry supply unit at a rear end of the first fence along the rotational direction, and configured to supply a slurry to the polishing pad, and a polishing head at a rear end of the slurry supply unit along the rotational direction, and configured to rotate a semiconductor substrate in contact with the polishing pad.

According to an aspect of the present inventive concept, a polishing method for a substrate is provided, the polishing method for a substrate including operations of: disposing a semiconductor substrate on a platen using a polishing head, contacting the semiconductor substrate on a polishing pad rotating in a rotational direction, spraying a temperature control fluid onto the polishing pad, controlling a flow of the temperature control fluid by using a fence extending from a center of the polishing pad outwardly at a rear end of a region from which the temperature control fluid is sprayed along the rotational direction, supplying a slurry on the polishing pad at the rear end of the fence along the rotational direction, and polishing the semiconductor substrate.

BRIEF DESCRIPTION OF DRAWINGS

The above and other aspects, features, and advantages of the present inventive concept will be more clearly understood from the following detailed description taken in conjunction with the accompanying drawings, in which.

DETAILED DESCRIPTION

Hereinafter, example embodiments of the present inventive concept will be described with reference to the accompanying drawings as follows.

Figure 1:
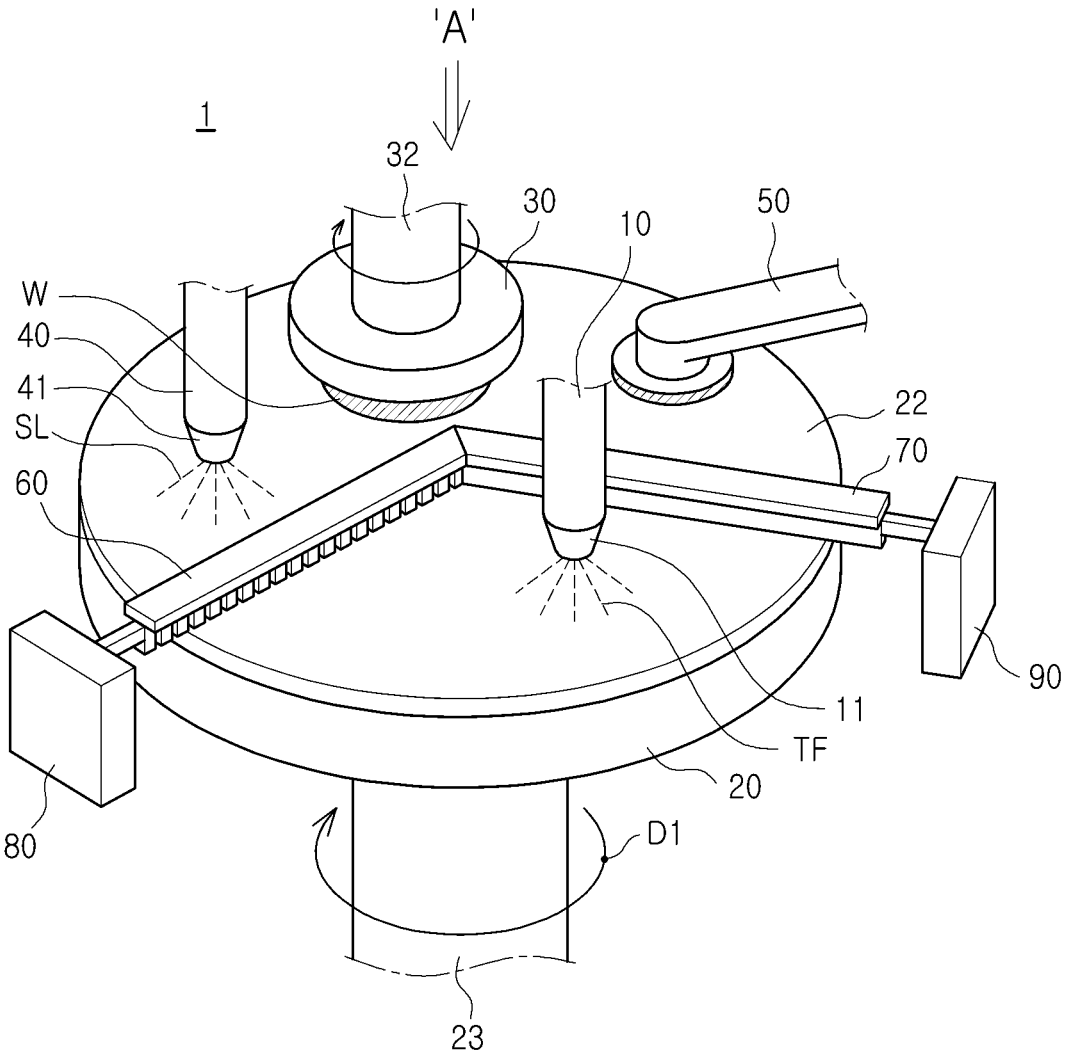
FIG. 1 is a schematic perspective view of a polishing apparatus for a substrate according to an example embodiment.
Figure 2:
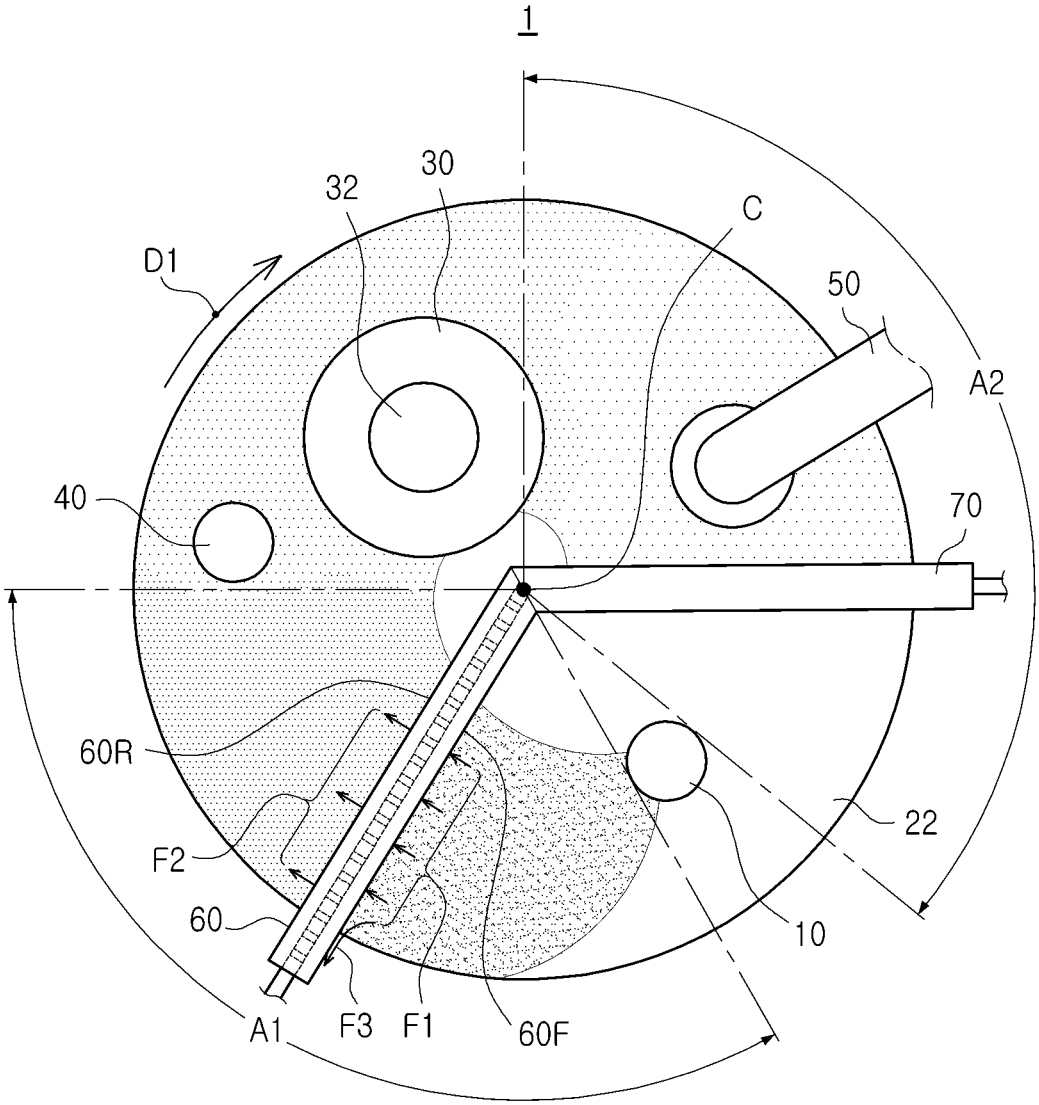
FIG. 2 is a plan view viewed in direction of 'A' of FIG. 1.

Referring to FIGS. 1 and 2, a polishing apparatus for a substrate according to an example embodiment will be described with reference to FIGS. 1 and 2. FIG. 1 is a schematic perspective view of a polishing apparatus for a substrate according to an example embodiment, and FIG. 2 is a plan view viewed from a direction of 'A' of FIG. 1.

Referring to FIG. 1, in a polishing apparatus for a substrate 1, a temperature control unit 10, a first fence 60, a slurry supply unit 40, a polishing head 30, a conditioner 50, and a second fence 70 may be sequentially positioned on a platen 20 along a rotational direction of the platen 20. The polishing apparatus for a substrate 1 may polish one surface of a semiconductor substrate W such as a wafer.

The platen 20 may be formed in a disk shape, and a polishing pad 22 providing a space in which the semiconductor substrate W is chemically and mechanically polished may be attached to an upper surface thereof. The upper surface of the polishing pad 22 may serve as a polishing surface for polishing the semiconductor substrate W. In addition, the platen 20 may have a rotation shaft 23 connected to a lower portion thereof, to be rotated in a rotational direction D1 by a driving device such as a motor. The platen 20 may rotate in a clockwise direction or a counterclockwise direction with respect to a center C. According to an example embodiment, a case in which the platen 20 rotates in a clockwise direction will be described as an example.

A semiconductor substrate W may be attached to a lower portion of the polishing head 30 by vacuum to be chemically and mechanically polished. The polishing head 30 may apply a certain polishing load to the semiconductor substrate W, to contact the semiconductor substrate W to the polishing pad 22, and be rotated by the rotation shaft 32 to chemically and mechanically polish a surface of the semiconductor substrate W. In addition, depending on the example embodiment, the polishing head 30 may perform a translational motion together with a rotational motion on the polishing pad 22.

The slurry supply unit 40 may be positioned above the polishing pad 22 and spaced apart from the polishing head 30. The slurry supply unit 40 may be at a front end of the polishing head 30 along the rotational direction D1. The slurry supply unit 40 may include at least one nozzle 41 and may spray a slurry SL on a surface of the polishing pad 22 through the nozzle 41. After the slurry SL sprayed from the slurry supply unit 40 is used to polish a surface of the semiconductor substrate W by the polishing head 30, it may be discharged outwardly of the platen 20. According to an example embodiment, the slurry supply unit 40 may spray the slurry SL in a heated or cooled state. The slurry SL supplied from the slurry supply unit 40 reacts with the surface of the semiconductor substrate W attached to the polishing head 30 to be used to perform a chemical mechanical polishing process. A polishing degree of the chemical mechanical polishing process is affected by a chemical action of the slurry SL, and thus is affected by the surface temperature of the polishing pad 22. Therefore, it is important to maintain the temperature of the polishing pad 22 on which a polishing process is performed at an optimum value. When a polishing process is performed in the polishing head 30 positioned at the rear end of the slurry supply unit 40, a temperature of the slurry SL may increase due to friction between the polishing head 30 and the polishing pad 22, so that a flow rate of the slurry SL sprayed from the slurry supply unit 40 may be adjusted in advance, it may be helpful to maintain the temperature of the slurry SL heated in the polishing head 30 at an optimized temperature in the chemical mechanical polishing process. However, since the slurry SL used in the polishing process is an expensive product, if the flow rate is increased, it may cause an increase in the cost of the manufacturing process. Therefore, there is a limit to controlling the temperature of the polishing pad 22 at a high speed using only the slurry SL. In the polishing apparatus for a substrate 1 of an example embodiment, the temperature control unit 10 may be at a front end of the slurry supply unit 40, and the temperature control fluid TF may be sprayed to the polishing pad 22, to compensate for the limitation of the temperature control of the polishing pad 22 by the slurry SL.

The temperature control unit 10 may be above the polishing pad 22 and spaced apart from the slurry supply unit 40. The temperature control unit 10 may be at a front end of the slurry supply unit 40 along the rotational direction D1. The temperature control unit 10 may spray a temperature control fluid TF on an upper surface of the polishing pad 22, to control a surface temperature of the polishing pad 22. The temperature control unit 10 may be provided with at least one nozzle 11 and spray a temperature control fluid TF on a surface of the polishing pad 22 through the nozzle 11 to raise or lower the surface temperature of the polishing pad 22. As the temperature control fluid TF, a liquid such as pure water (DI water) may be used, and a gas such as nitrogen gas ($N_2$ gas) or air may be used.

The temperature control fluid TF provided from the temperature control unit 10 may be useful for controlling a temperature of the polishing pad 22 by compensating for an insufficient temperature controlling effect of the slurry SL, but the temperature control fluid TF may be made of a material, different from that of the slurry SL, and when the temperature control fluid TF is mixed with the slurry SL, a polishing degree of the slurry SL is lowered. Therefore, the temperature control fluid TF sprayed from the temperature control unit 10 outwardly of the platen 20 may be quickly discharged before being mixed with the slurry SL. When a flow rate of the sprayed temperature control fluid TF is relatively small, the temperature control fluid TF may be removed only by rotating the platen 20. However, when the flow rate of the sprayed temperature control fluid TF is relatively large, a problem in which the temperature control fluid TF is mixed with the slurry SL may occur. In addition, when the temperature control fluid TF is discharged too quickly, an effect of controlling the surface temperature of the polishing pad 22 using the temperature control fluid TF may be reduced.

In an example embodiment, by disposing a first fence 60 between the temperature control unit 10 and the slurry supply unit 40, it is possible to separate the temperature control fluid TF and the slurry SL, e.g., to prevent the temperature control fluid TF and the slurry SL from being mixed, while allowing the temperature control fluid TF to remain on a surface of the polishing pad 22 for a time sufficient to control the surface temperature of the polishing pad 22.

Referring to FIG. 2, the first fence 60 may be between the temperature control unit 10 and the slurry supply unit 40, to control a flow rate of the temperature control fluid TF supplied from the temperature control unit 10. The first fence 60 may be formed in a bar shape and may be formed of various types of synthetic resins. For example, the first fence 60 may be formed of polyvinyl alcohol.

Figure 3:
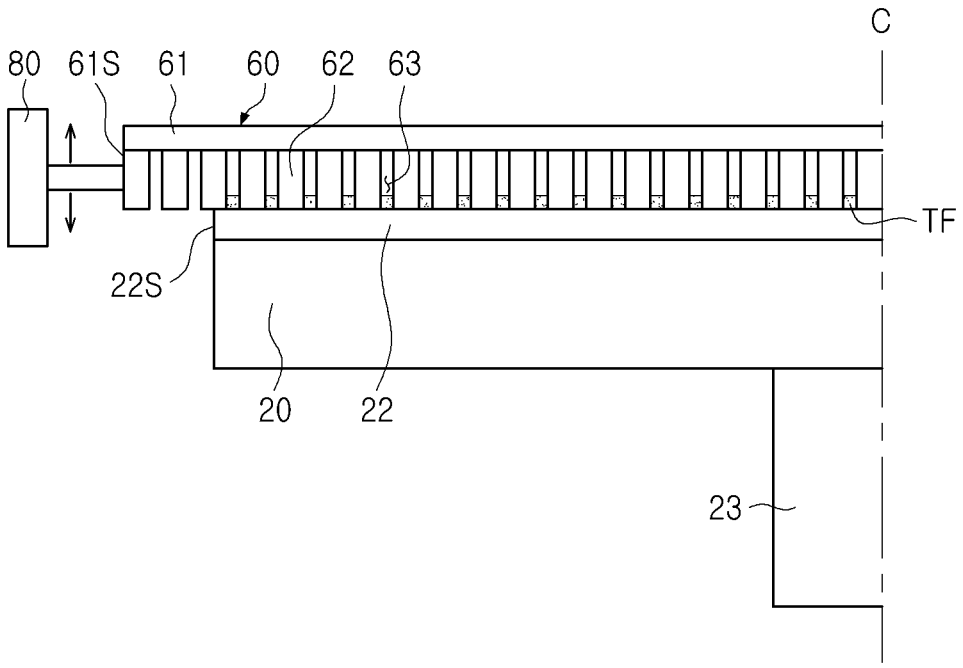
FIG. 3 is a side view of the first fence of FIG. 1.

Referring to FIG. 3, one end of the first fence 60 may be at a center C of the polishing pad 22, and the other end thereof may be configured to protrude toward an outer peripheral portion 22S of the polishing pad 22. The first fence 60 may be in contact with an upper surface of the polishing pad 22. However, the present inventive concept is not limited thereto, and a first driving unit 80 may be connected to the other end of the first fence 60, to adjust a gap between a lower surface of the first fence 60 and an upper surface of the polishing pad 22, and when the first fence 60 is not required, it may be separated from the polishing pad 22.

The first fence 60 may be spaced apart from the temperature control unit 10. When the first fence 60 is positioned very close to the temperature control unit 10, before the temperature control fluid TF supplied from the temperature control unit 10 sufficiently controls a temperature of the polishing pad 22, it is discharged to the outer peripheral portion 22S of the polishing pad 22 by the first fence 60, so that an effect of controlling the surface temperature of the polishing pad 22 may be reduced using the temperature control fluid TF.

Referring to FIGS. 2 and 3, the first fence 60 may include a body portion 61 and a brush 62. The brush 62 may be below the body portion 61. According to an example embodiment, the body portion 61 and the brush 62 may be integrally formed.

Figure 5A:
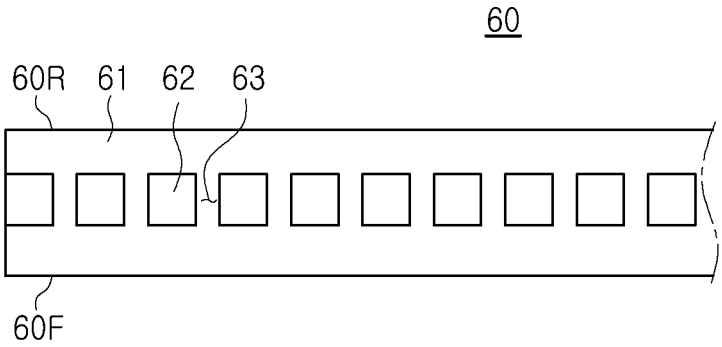
FIG. 5A is a view illustrating a lower surface of the first fence of FIG. 1.
Figure 5B:
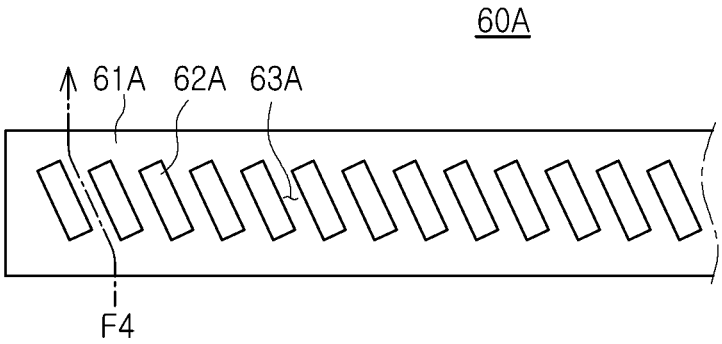
FIGS. 5B to 5D illustrate various modified examples of the first fence illustrated in FIG. 5A.

Referring to FIG. 5A, a plurality of flow paths 63 penetrating through a front surface 60F and a rear surface 60R of the first fence 60 may be formed in the brush 62. The plurality of flow paths 63 may be variously modified. Referring to FIG. 5B, the first fence 60A may form a flow path F4 in which a plurality of flow paths 63A of the brush 62A are inclined.

Figure 5C:
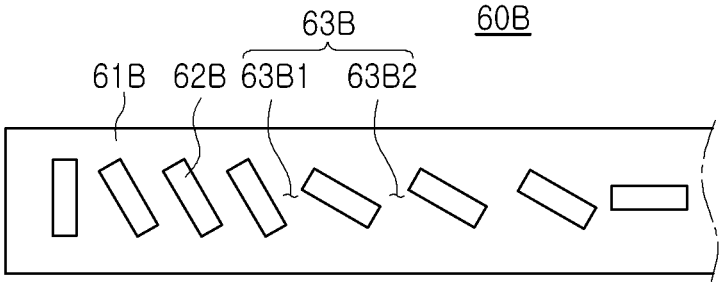

Referring to FIG. 5C, in the case of the first fence 60B, the brush 62B may have a plurality of flow paths 63B gradually increasing in width. That is, one flow path 63B1 among the plurality of flow paths 63B may have a width, different from that of the other adjacent flow path 63B2. Accordingly, it may be controlled so that the temperature control fluid TF having a different flow rate flows in each region of the first fence 60B.

Figure 5D:
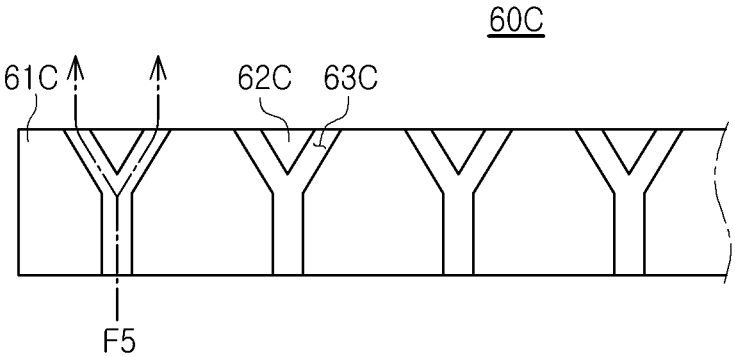

Referring to FIG. 5D, in the case of the first fence 60C, the brush 62C may have a Y-shaped flow path 63C so that the temperature control fluid TF introduced from a front surface of the first fence 60C flows out to two flow paths.

Referring to FIGS. 2 and 3, the plurality of flow paths 63 may control a flow rate of the temperature control fluid TF passing through the first fence 60. The temperature control fluid TF supplied from the temperature control unit 10 flows along a first flow path F1 that spreads over the upper surface of the polishing pad 22 by the rotational motion of the platen 20. A portion of the temperature control fluid TF flowing along the first flow path F1 flows along a third flow path F3 blocked by the first fence 60 and is discharged to an outer peripheral portion 22S of the polishing pad 22. The remainder of the temperature control fluid TF that is not discharged to the outer peripheral portion 22S of the polishing pad 22 among the temperature control fluid TF flows along a second flow path F2 penetrating through the first fence 60 through the plurality of flow paths 63 of the first fence 60. The temperature control fluid TF that has passed through the first fence 60 is gradually discharged to the outer peripheral portion 22S of the polishing pad 22 by the rotational motion of the platen 20 and may adjust a width of the plurality of flow paths 63, to adjust a region A1 through which the temperature control fluid TF passing through the first fence 60 spreads. Therefore, while the temperature control fluid TF supplied from the temperature control unit 10 is supplied to control a surface temperature of the polishing pad 22, and the temperature control fluid TF may not be mixed with the slurry SL suppled from the slurry supply unit 40.

Referring to FIG. 2, a second fence 70 may be between the polishing head 30 and the temperature control unit 10, and may be formed in a bar shape, similar to the first fence 60. According to an example embodiment, the second fence 70 may be omitted. The second fence 70 may be formed in a bar shape, similar to the first fence 60, and may be formed of various types of synthetic resins. The second fence 70 may be formed of the same material as the first fence 60, but according to an example embodiment, the second fence 70 may be formed of a material, different from that of the first fence 60. For example, the second fence 70 may be formed of polyvinyl alcohol.

Figure 4:
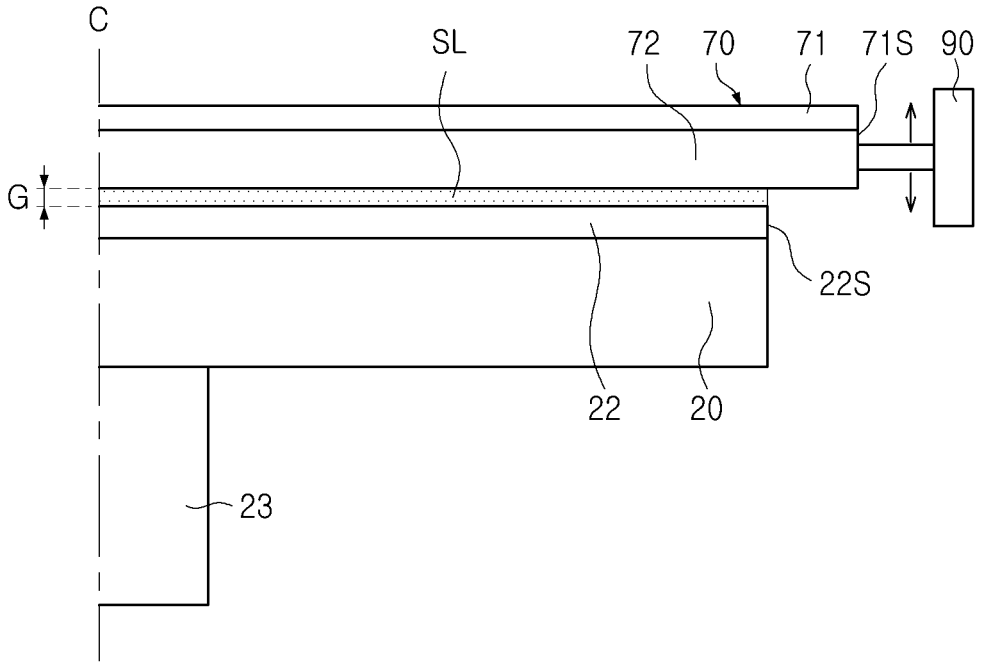
FIG. 4 is a side view of the second fence of FIG. 1.

Referring to FIG. 4, one end of the second fence 70 may be in a center C of the polishing pad 22, and the other end thereof may be configured to protrude toward the outer peripheral portion 22S of the polishing pad 22. The second fence 70 may be in contact with an upper surface of the polishing pad 22. However, the present inventive concept is not limited thereto, and a second driving unit 90 may be connected to the other end of the second fence 70, to adjust a gap G between a lower surface of the second fence 70 and an upper surface of the polishing pad 22. By controlling the gap G between the lower surface of the second fence 70 and the upper surface of the polishing pad 22, the slurry SL containing polishing by-products generated while a chemical mechanical polishing process in the polishing head 30 is performed on the outer peripheral portion of the platen 20, or to allow a portion of the slurry SL to pass therethrough. In addition, the second fence 70 may be driven by the second driving unit 90 and may be separated from the polishing pad 22 when the second fence 70 is not required. The second fence 70 may be in contact with the first fence 60 in the center C of the polishing pad 22. According to an example embodiment, the second fence 70 may be formed integrally with the first fence 60.

The conditioner 50 may be between the polishing pad 22 and the temperature control unit 10. When the second fence 70 is between the polishing pad 22 and the temperature control unit 10, the conditioner 50 may be at a rear end of the second fence 70. The conditioner 50 may perform a conditioning process of polishing a surface of the polishing pad 21 with a disk to which diamond particles are attached in order to make a surface state of the polishing pad 21 uniform, thereby reproducing roughness of the polishing pad 21.

Figure 6:
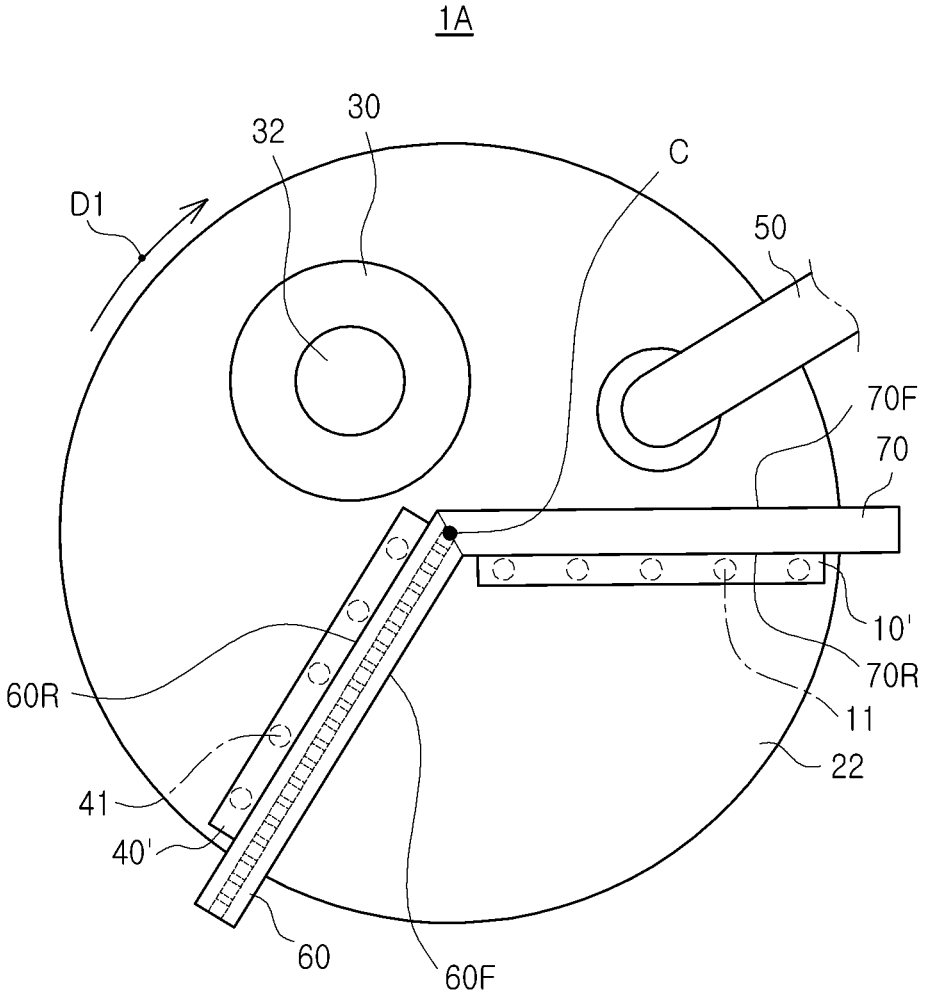
FIG. 6 is a plan view of a polishing apparatus for a substrate according to an example embodiment.

A polishing apparatus for a substrate according to an example embodiment will be described with reference to FIG. 6. FIG. 6 is a plan view of a polishing apparatus for a substrate according to an example embodiment. A polishing apparatus for a substrate 1A of an example embodiment has a difference in that the temperature control unit 10 and the slurry supply unit 40 have a bar shape as compared to the above-described embodiment. Since other configurations are the same as those of the above-described embodiment, descriptions thereof are omitted to prevent overlapping.

The polishing apparatus for a substrate 1A of an example embodiment may include a bar-shaped or rectangular temperature control unit 10'. In the temperature control unit 10', a plurality of nozzles 11 may be arranged in a row from a center of the polishing pad 22 outwardly. The plurality of nozzles 11 may be arranged at equal intervals. Therefore, compared to the above-described embodiment, the temperature control fluid TF sprayed from the temperature control unit 10' may be more uniformly sprayed onto the polishing pad 22.

In addition, the polishing apparatus for a substrate 1A according to an example embodiment may include a bar-shaped or rectangular slurry supply unit 40'. In the slurry supply unit 40', a plurality of nozzles 41 may be arranged in a row from a center of the polishing pad 22 outwardly. The plurality of nozzles 41 may be arranged at equal intervals. Accordingly, compared to the above-described embodiment, the slurry SL sprayed from the slurry supply unit 40' may be more uniformly sprayed onto the polishing pad 22.

Figure 7:
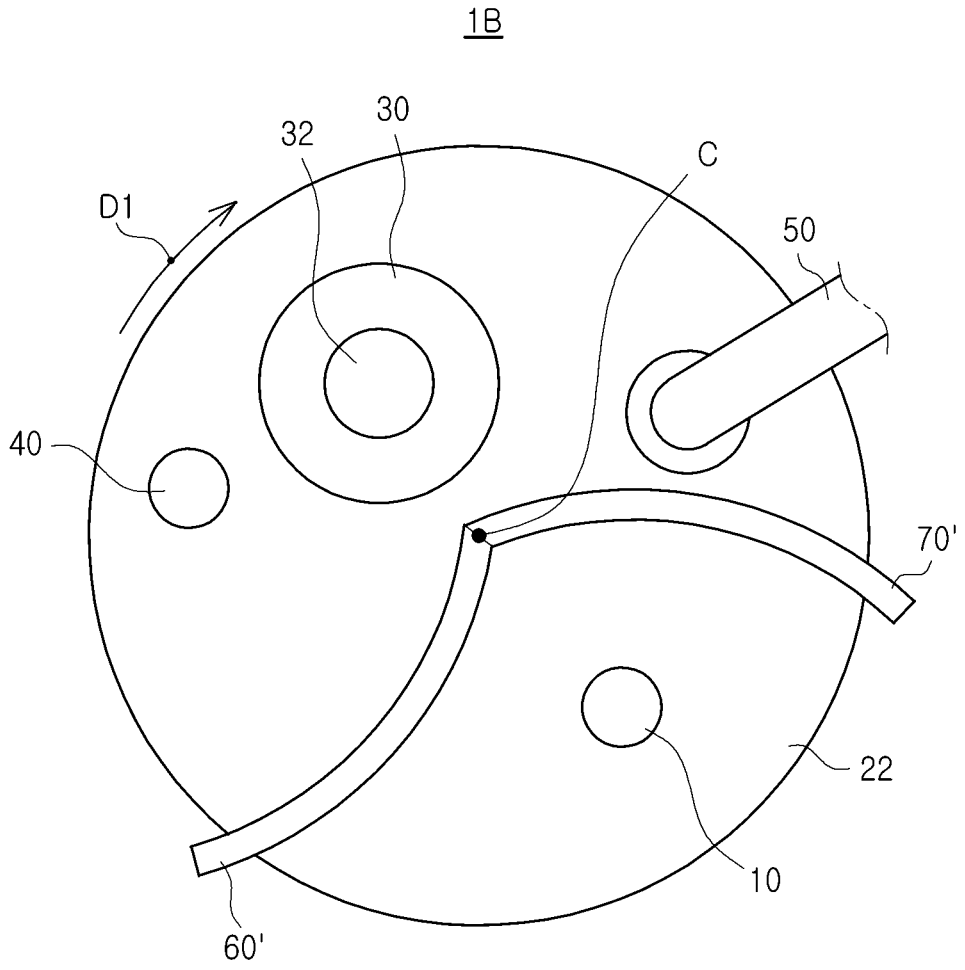
FIG. 7 is a plan view of a polishing apparatus for a substrate polishing according to an example embodiment.

A polishing apparatus for a substrate according to an example embodiment will be described with reference to FIG. 7. FIG. 7 is a plan view of a polishing apparatus for a substrate according to an example embodiment. A polishing apparatus for a substrate 1B of an example embodiment has a difference in that the first fence 60' and the second fence 70' have a curved shape as compared to the above-described embodiment. Since other configurations are the same as those of the above-described embodiment, descriptions thereof are omitted to prevent overlapping.

The polishing apparatus for a substrate 1B of an example embodiment may be formed in a curved shape from a center of the polishing pad 22 outwardly in the rotational direction D1, which is a rotational direction of the polishing pad 22.

Since the first fence 60' and the second fence 70' have a shape curved in the rotational direction of the polishing pad 22, damages to the first fence 60' and the second fence 70' on the polishing pad 22 rotating at high speed may be reduced or prevented.

Next, a polishing method for a substrate according to an example embodiment will be described. The polishing method for a substrate may be performed using a polishing apparatus for a substrate 1 of FIG. 1. A detailed description of the polishing apparatus for a substrate of FIG. 1 will be omitted.

First, a semiconductor substrate W may be attached to the polishing head 30 of the polishing apparatus for a substrate 1 and positioned on the platen 20.

Next, the semiconductor substrate W may be in contact with the polishing pad 22 rotating in the rotational direction D1.

Next, a temperature of the polishing pad 22 may be controlled by spraying a temperature control fluid TF on the polishing pad 22. The temperature control fluid TF may be controlled to maintain a temperature in a polishing process at an optimal temperature, in consideration of the temperature of the polishing process performed in the polishing head 30. The temperature control fluid TF sprayed onto the polishing pad 22 may spread over a surface of the polishing pad 22 in the rotational direction D1 by the rotation of the platen 20 to raise or lower a surface temperature of the polishing pad 22.

Next, along the rotational direction D1, a first fence 60 may extend from a center C of the polishing pad 22 outwardly at a rear end of a region where the temperature control fluid TF is sprayed, to control a flow of the temperature control fluid TF. The temperature control fluid TF supplied from the temperature control unit 10 may spread along an upper surface of the polishing pad 22 by a rotational motion of the platen 20, a portion thereof may be blocked by the first fence 60 and be discharged outwardly of the polishing pad 22, and a remaining portion thereof may be gradually discharged outwardly of the polishing pad 22 by the rotational motion of the platen 20 after penetrating the first fence 60.

Next, the slurry supply unit 40 may supply a slurry SL to the polishing pad 22.

Next, the polishing head 30 may perform a chemical mechanical polishing process of the semiconductor substrate W on the polishing pad 22.

As set forth above, according to an example embodiment of the present inventive concept, in a polishing apparatus for a substrate and a polishing method for a substrate, a temperature control unit to which a temperature control fluid is supplied and a slurry supply unit to which a slurry is supplied may be spaced apart from each other, and a fence may be between the temperature control unit and the slurry supply unit, so that it is possible to optimize a surface temperature of a polishing pad in a CMP process, and prevent mixing of the temperature control fluid and the slurry.

While example embodiments have been shown and described above, it will be apparent to those skilled in the art that modifications and variations could be made without departing from the scope of the present inventive concept as defined by the appended claims. Accordingly, various types of substitution, modification and change will be possible by those skilled in the art within the scope of the present inventive concept described in the claims, and this also falls within the scope of the present inventive concept.

What is claimed is:

1. A polishing apparatus for a substrate, comprising:

a platen having a polishing pad attached to an upper surface thereof, the platen being configured to rotate the polishing pad in a rotational direction;

a temperature control unit configured to spray a temperature control fluid onto the polishing pad to control a temperature of the polishing pad;

a slurry supply unit on the polishing pad spaced apart from the temperature control unit along the rotational direction, and configured to supply a slurry to the polishing pad;

a polishing head on the polishing pad spaced apart from the slurry supply unit along the rotational direction, and configured to rotate a semiconductor substrate in contact with the polishing pad;

a first fence between the temperature control unit and the slurry supply unit along the rotational direction, and extending from a center of the polishing pad outwardly and configured to control a flow of the temperature control fluid, wherein the first fence comprises a plurality of flow paths extending from a front surface of the first fence to a rear surface of the first fence, wherein the plurality of flow paths are configured to permit partial penetration of the temperature control fluid through the first fence and to partially block the temperature control fluid; and a second fence between the polishing head and the temperature control unit along the rotational direction and extending from the center of the polishing pad outwardly and configured to control a flow of the slurry and polishing by-products remaining in the polishing pad, wherein the second fence does not comprise a flow path extending from a front surface of the second fence to a rear surface of the second fence.

2. The polishing apparatus of claim 1, wherein at least some of the plurality of flow paths are inclined.

3. The polishing apparatus of claim 1, wherein the plurality of flow paths gradually increases or decreases in width from the center of the polishing pad outwardly.

4. The polishing apparatus of claim 1, wherein the first fence is configured to separate the temperature control fluid from the temperature control unit and the slurry from the slurry supply unit.

5. The polishing apparatus of claim 1, further comprising:

a conditioner between the polishing head and the temperature control unit along the rotational direction and controlling a surface state of the polishing pad.

6. The polishing apparatus of claim 5, wherein the second fence is between the conditioner and the temperature control unit along the rotational direction.

7. The polishing apparatus of claim 6, further comprising a rotation shaft between the slurry supply unit and the conditioner along the rotational direction.

8. The polishing apparatus of claim 1, wherein the temperature control unit further comprises a nozzle configured to spray the temperature control fluid onto a surface of the polishing pad.

9. The polishing apparatus of claim 8, wherein the temperature control unit has a rectangular body extending from the center of the polishing pad outwardly, the nozzle comprises a plurality of nozzles, and the plurality of nozzles is positioned along a longitudinal direction of the body.

10. The polishing apparatus of claim 9, wherein the temperature control unit is in contact with a side surface of the first fence.

11. The polishing apparatus of claim 1, wherein the first and second fences are connected to first and second driving units, respectively, and are configured to be vertically moved with respect to an upper surface of the polishing pad by the first and second driving units.

12. The polishing apparatus of claim 1, wherein the second fence is spaced apart from an upper surface of the polishing pad.

13. The polishing apparatus of claim 1, wherein the first and second fences are curved from the center of the polishing pad outwardly.

14. The polishing apparatus of claim 1, wherein the first fence and the second fence are in contact with each other in the center of the polishing pad.

15. The polishing apparatus of claim 1, wherein the temperature control fluid flows along a first flow path that spreads over the upper surface of the polishing pad, wherein a portion of the temperature control fluid flowing along the first flow path flows along a second flow path blocked by the first fence and is discharged to an outer peripheral portion of the polishing pad.

16. The polishing apparatus of claim 1, wherein the second fence lacks flow paths.

17. A polishing apparatus for a substrate, comprising:

a platen having a polishing pad attached to an upper surface thereof, the platen being configured to rotate the polishing pad in a rotational direction;

a temperature control unit configured to spray a temperature control fluid onto the polishing pad;

a slurry supply unit configured to supply a slurry to the polishing pad;

a polishing head on the polishing pad, and configured to rotate a semiconductor substrate in contact with the polishing pad; and a first fence between the temperature control unit and the slurry supply unit along the rotational direction extending from a center of the polishing pad outwardly and configured to control a flow of the temperature control fluid, wherein the first fence comprises a plurality of flow paths extending from a front surface of the first fence to a rear surface of the first fence, wherein the plurality of flow paths are configured to permit partial penetration of the temperature control fluid through the first fence and to partially block the temperature control fluid; and a second fence between the polishing head and the temperature control unit along the rotational direction and extending from the center of the polishing pad outwardly and configured to control a flow of the slurry and polishing by-products remaining in the polishing pad, wherein the second fence does not comprise a flow path extending from a front surface of the second fence to a rear surface of the second fence, wherein the temperature control unit, the slurry supply unit, and the polishing head are sequentially positioned along the rotational direction.

18. The polishing apparatus of claim 17, wherein the first fence and the second fence are made of the same material.

19. A polishing apparatus for a substrate, comprising:

a platen supporting a polishing pad and configured to rotate in a rotational direction;

a temperature control unit configured to spray a temperature control fluid onto the polishing pad;

a first fence downstream from the temperature control unit along the rotational direction, and extending from a center of the polishing pad outwardly to control a flow of the temperature control fluid, wherein the first fence comprises a plurality of flow paths extending from a front surface of the first fence to a rear surface of the first fence, wherein the plurality of flow paths are configured to permit partial penetration of the temperature control fluid through the first fence and to partially block the temperature control fluid;

a slurry supply unit downstream from the first fence along the rotational direction, and configured to supply a slurry to the polishing pad;

a polishing head downstream from the slurry supply unit along the rotational direction, and configured to rotate a semiconductor substrate in contact with the polishing pad; and a second fence between the polishing head and the temperature control unit along the rotational direction and extending from the center of the polishing pad outwardly and configured to control a flow of the slurry and polishing by-products remaining in the polishing pad, wherein the second fence does not comprise a flow path extending from a front surface of the second fence to a rear surface of the second fence.

* * * * *